United States Patent [19]

Berthold

[11] 4,443,160

[45] Apr. 17, 1984

[54] HIGH-PRESSURE PISTON PUMP FOR LIQUIDS, PREFERABLY FOR WATER

[75] Inventor: Heinz Berthold, Bildechingen, Fed. Rep. of Germany

[73] Assignee: Brueninghaus Hydraulik GmbH, Horb, Fed. Rep. of Germany

[21] Appl. No.: 318,065

[22] Filed: Nov. 4, 1981

[30] Foreign Application Priority Data

Nov. 13, 1980 [DE] Fed. Rep. of Germany ..... 3042835

[51] Int. Cl.[3] ..... F04B 1/18; F04B 35/02

[52] U.S. Cl. ..... 417/270; 417/388

[58] Field of Search ..... 417/269, 383, 385, 388, 417/389, 270

[56] References Cited

U.S. PATENT DOCUMENTS

| | | | |
|---|---|---|---|
| 1,797,245 | 3/1931 | Schaer | 417/385 |
| 2,624,284 | 1/1953 | Straub | 417/388 |
| 2,807,215 | 9/1957 | Hawxhurst | 417/385 |
| 3,080,820 | 3/1963 | Browne | 417/383 |
| 3,292,554 | 12/1966 | Hessler | 417/269 |
| 3,612,727 | 10/1971 | Drake | 417/388 |
| 3,680,981 | 8/1972 | Wagner | 417/388 |
| 3,961,860 | 6/1976 | Ernst | 417/388 |

FOREIGN PATENT DOCUMENTS

| | | | |
|---|---|---|---|
| 1498329 | 1/1969 | Fed. Rep. of Germany | 417/389 |
| 2923284 | 12/1980 | Fed. Rep. of Germany | 417/388 |
| 961750 | 6/1964 | United Kingdom | 417/383 |
| 964000 | 7/1964 | United Kingdom | 417/269 |

*Primary Examiner*—William L. Freeh

*Attorney, Agent, or Firm*—Scully, Scott, Murphy & Presser

[57] ABSTRACT

A high-pressure piston pump for liquids, preferably for water, which includes a valve control through a suction and pressure valve, in which the pump pistons are movable at least in the pressure direction through the intermediary of a hydraulic drive. The hydraulic drive encompasses an axial piston machine with an oblique disk construction with an adjustable, rotationally driven inclined disk for adjustment of the stroke, whose drive pistons are each presently coupled through a hydraulic column with one of the pump pistons.

9 Claims, 2 Drawing Figures

HIGH-PRESSURE PISTON PUMP FOR LIQUIDS, PREFERABLY FOR WATER

BACKGROUND OF THE INVENTION

1. Field of the Invention

The present invention relates to a high-pressure piston pump for liquids, preferably for water, which includes a valve control through a suction and pressure valve, in which the pump pistons are movable at least in the pressure direction through the intermediary of a hydraulic drive.

2. Discussion of the Prior Art

Known liquid pumps, particularly water pumps, are constructed as plunger pumps with valve control. The drive and the movement of the pistons is generally effected through a crank mechanism. A pressure regulation of pumps of that type is effectuated either through a by-pass control, torque converter, rotational speed-regulated direct-current drive or double-swing drive. Directly influenced by the last-mentioned type of drive is the piston stroke and, as a result, the discharge pressure.

Also known is a pump construction for liquid pumps of that type in which the pistons, as in an axial piston pump, are arranged about a central axis. This type of construction facilitates a simple regulation of the piston stroke. However, encountered herein is the problem in the lubrication of the drive elements of such an axial piston machine. In order to ensure the trouble-free function of a pump which is constructed in that manner, a lubricating medium pressure must be built up within a special lubricating medium circuit which is proportional to the liquid pressure.

A piston pump of the above-mentioned type has become known, for example, from German Published Patent Application No. 1 019 563. Therein, the pump pistons of the liquid pump are driven through a hydrostatic drive, consisting of an axial piston pump and hydraulic operating cylinders, which stand in communication with the pump pistons. A piston pump which is driven in that manner can be regulated only through considerable constructional demands on the stroke volume and thereby in the discharge pressure. For a steam or compressed-air pump there must be provided the usual pilot control system.

SUMMARY OF THE INVENTION

Accordingly, it is an object of the present invention to provide a high-pressure piston pump which in a simple manner is adjustable in its discharge stroke, without being subjected to the mentioned lubricating problems, and which in a further modification provides the capability of a simple pressure regulation through adjustment of the discharge stroke.

In order to achieve the foregoing object in a high-pressure piston pump of the above-mentioned type, there is inventively proposed that the hydraulic drive encompasses an axial piston machine with an oblique disk construction with an adjustable, rotationally driven inclined disk for adjustment of the stroke, whose drive pistons are each presently coupled through a hydraulic column with one of the pump pistons.

With respect to a hydraulic column there is to be understood that this comprises an enclosed pressurized liquid volume which serves as an energy transmitting element between the drive side, here formed as an axial piston machine which is simply adjustable in stroke, and the pump pistons of the liquid pump. The piston pump and the drive side of the axial piston machine are coupled energy-transmissively through a hydraulic column without that the above-mentioned lubricating problems will be encountered in the axial piston machine. Additionally, the hydraulic columns facilitate a suitable spatial arrangement of the drive pistons of the axial piston machine and relative to the pump piston of the liquid pump.

In an advantageous embodiment of the invention, the pressurized liquid of the hydraulic column consists of a high grade hydraulic oil and is enclosed between each drive piston of the axial piston machine and a pressure piston, which directly acts on a pump piston. The pump pistons are acted upon in a known manner by a pump spring in the suction direction and are movable against the, in this instance, practically pressureless hydraulic columns.

The arrangement of the previously mentioned pressure pistons facilitates, in a simple manner, that by means of the hydraulic columns it is possible to have a pressure increase or pressure reduction. The pressure piston, in a suitable embodiment of the invention, is formed as a pressure increasing piston with an effective piston surface facing towards the hydraulic column, which is larger than the effective piston surface of the associated pump piston. The pressure piston, in a further advantageous embodiment of the invention, is formed as a pressure reducing piston with an effective piston surface facing towards the hydraulic column, which is smaller than the effective piston surface of the associated pump piston.

In a further advantageous embodiment of the invention, the hydraulic columns are connected with a pressurized medium source for the infeed of pressurized liquid lost through leakage by means of only one inlet valve opening towards the hydraulic column. The leakage losses of the hydraulic columns which are produced by the pressure stroke on the pressure piston and on the drive piston of the axial piston machine, as well as at the lubricated locations supplied by the pressurized liquid of the hydraulic column in the axial piston machine are replenished during the suction stroke through the pressurized medium source, which is suitably constructed as an auxiliary pump.

Suitably, in addition to the pressurized medium source and inlet valve or valves, there is provided a pressure limiting valve, with possibly a pressurized medium cooler and/or filter connected thereto which maintains the inlet pressure so low that the force acting on the pressure increasing or reducing piston is smaller than the resetting force of the pump piston under the action of the pump spring.

In a further advantageous embodiment of the invention the hydraulic columns are connected with a pressure-limiting valve through one discharge valve opening only towards the pressure-limiting valve. Due to the pressure-limiting valve which is associated with each hydraulic column, which conveys pressurized liquid of the hydraulic columns towards outlet upon reaching of the pressure predetermined by the pressure-limiting valve in the hydraulic columns, it is possible to predetermine the maximum discharge pressure of the liquid pump. Suitably, the pressure-limiting valve is constructed so as to be adjustable.

A particularly advantageous construction of the invention is obtained when, dependent upon the extent of the pressure in the hydraulic column, there is branched off an adjusting pressure which acts either directly or indirectly upon the adjusting arrangement for the adjustable oblique disk of the axial piston machine. Hereby it is suitable that a throttle is arranged between the pressure-limiting valve associated with the hydraulic column and the outlet, and the pressure head which is produced ahead of the throttle is transmitted as the adjusting pressure to the adjusting arrangement for the oblique disk. This will render possible a pressure regulation for the liquid pump, without that the pressure of the liquid, preferably water, is utilized directly as the control signal. Serving as the control signal is the pressure level of the hydraulic column from which there is branched off a proportional adjusting pressure which is utilized for the stroke adjustment of the axial piston machine. A simple hydraulic-mechanical regulation of the water pressure of the piston pump is thereby realized.

BRIEF DESCRIPTION OF THE DRAWINGS

Reference may now be had to an exemplary embodiment of the piston pump, taken in conjunction with the accompanying drawings; in which.

DETAILED DESCRIPTION

Figure 1:
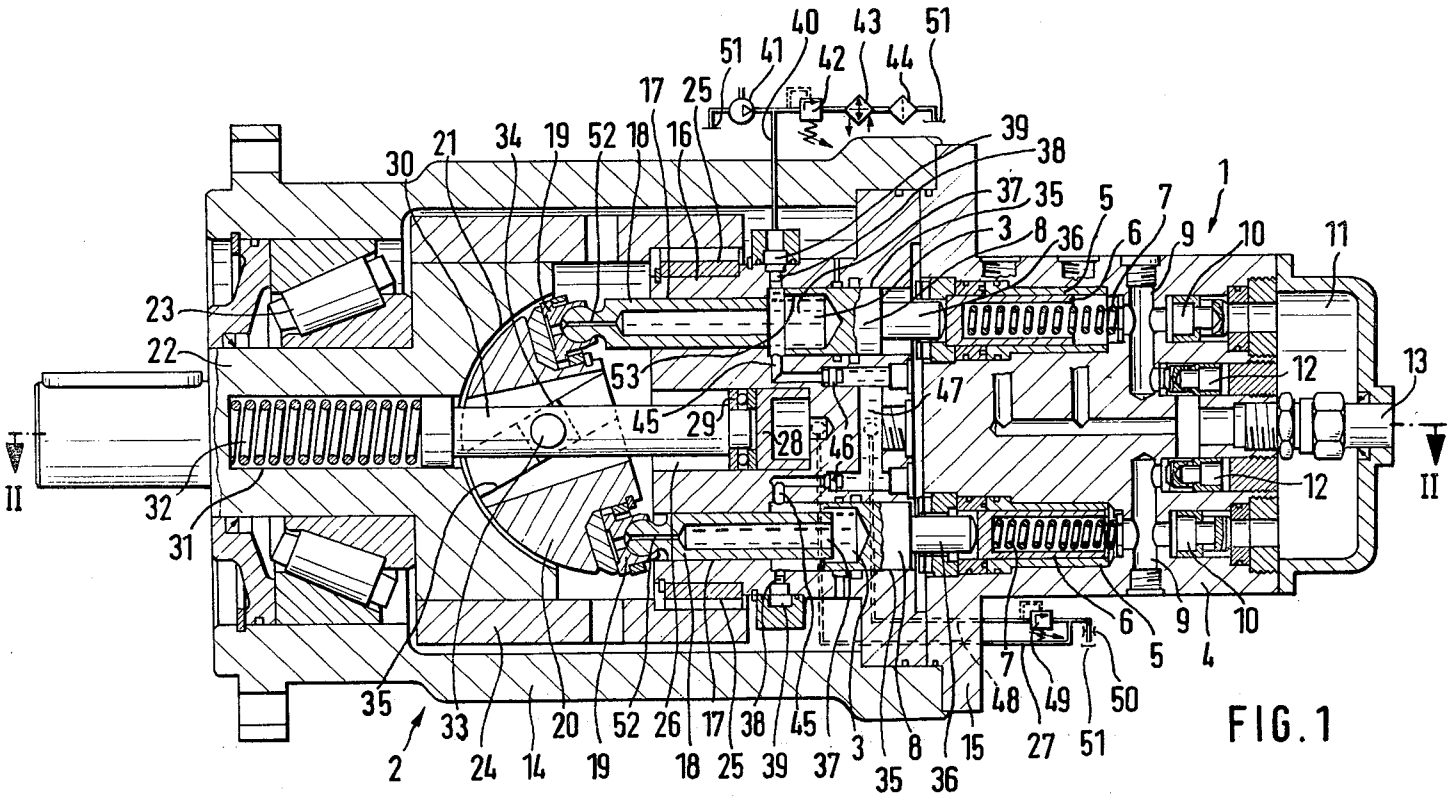
FIG. 1 schematically illustrates, in section, a piston pump with an axial piston machine as a hydraulic drive.
Figure 2:
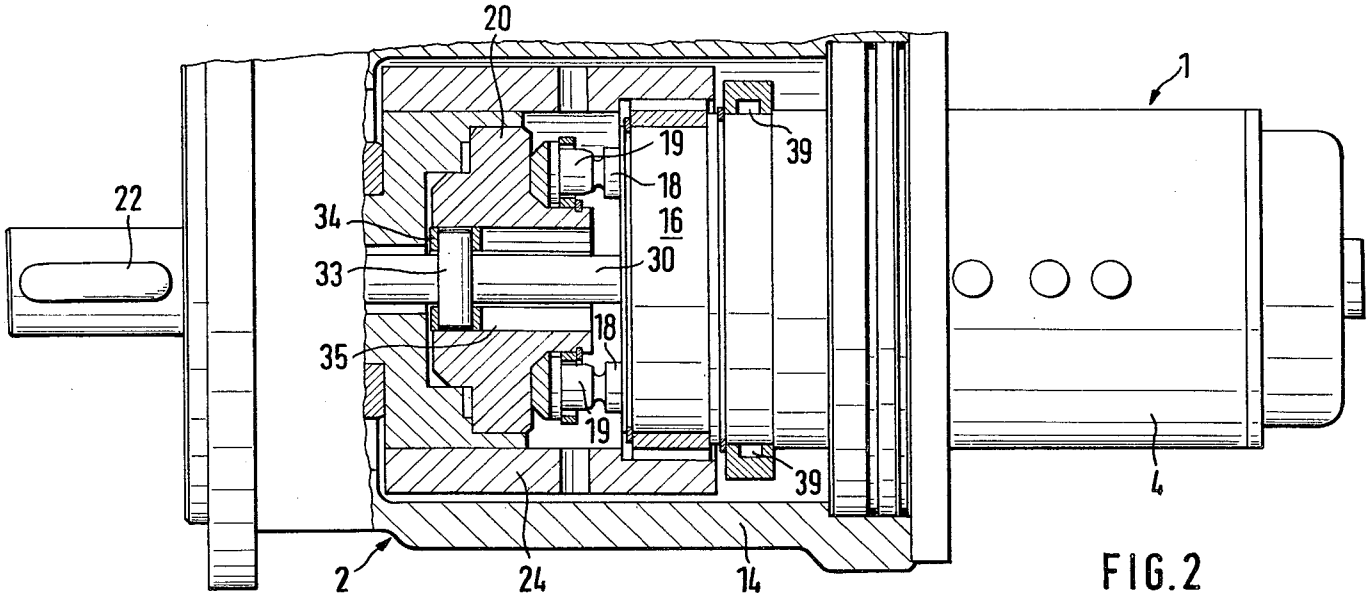
FIG. 2 is a top plan view, partly in section, of the piston pump with the axial piston machine according to FIG. 1 taken along line II—II in FIG. 1.

The illustrated high-pressure piston pump for liquids essentially consists of two separate regions, the liquid pump region 1 and the axial piston machine region 2 serving as the hydraulic drive component, wherein the two mentioned regions are coupled energy-transmissively through hydraulic columns 3. The pump region 1 consists of a pump body 4 in which pump pistons 6 are arranged in cylinders 5. They are acted upon from one side by pump springs 7 (towards the left in FIG. 1) and in the opposite direction (FIG. 1 towards the right) by pressure pistons 8. The cylinder chambers 5 are connected in a known manner, by means of passageways 9 and suction valves 10 with the liquid inlet 11 and pressure valves 12 with the liquid outlet 13. The function of such a liquid pump through the reciprocating movement of the pump pistons 6 is known.

The axial piston machine region 2 encompasses a housing 14 which is mounted on a flange 15 of the pump body 4. Fixedly located within the housing 14 is a cylinder member 16, in the cylinder bores 17 of which there are arranged drive pistons 18. The drive pistons 18 are supported against an oblique disk 20 by means of pressure guides 19 and, in accordance with the adjusted inclined position of the oblique disk 20 are reciprocated within the cylinders 17. The oblique disk 20 is pivotally arranged in a hemispherical shell 21 in the drive shaft 22 and fixedly connected with the drive shaft 22. The drive shaft 22 is supported in the housing 14 through a roller bearing arrangement 23. The roller bearing arrangement 23 can also be replaced by a slide bearing. A cylinder member 24 is fixedly connected with the drive shaft 22, which is rotatably supported by means of a slide bearing 25 against the outside of the cylinder member 16.

As an adjusting device for the setting of the inclined position of the oblique disk 20 formed in the cylinder member 16 aligned in the axial direction with the drive shaft 22 through a blind bore is an adjusting cylinder 26, in which there is conducted an adjusting piston 28 acted upon by an adjusting pressure through a conduit 27. The adjusting piston 28 is connected through a bearing 29 with an adjusting rod 30, which is conducted within a guide 31 in the drive shaft 22 and is rotatable together with the drive shaft. The adjusting rod 30 stands under the action of a compression spring 32. The adjusting rod 30 carries a cross-bolt 33 on which there is arranged a sliding block 34 which is guided in an inclined extending slide 35 of the oblique disk 20. The oblique disk 20 is rotatably driven through the sliding block 34, the cross-bolt 33, and the adjusting rod 30, by the drive shaft 2. Through the axial displacement of the adjusting rod 30, and the therewith connected displacement of the sliding block 34 in the slide 35, the oblique disk 20 is adjusted in its inclined position.

Provided in the cylinder member 16, axially connecting to the cylinder bores 17, are widened cylinder bores 35 for the drive pistons 18, in which there are arranged the pressure pistons 8. Pressure pistons are integrally formed with pushers 36 which lie against the pump pistons 6. Spaces 37 are formed between the pressure pistons 8 and the drive pistons 18, which enclose a pressurized liquid volume which forms the hydraulic columns 3. The spaces 37 are connected through inlet valves 38 with an annular passageway 39 into which there connects an inlet conduit 40. The inlet conduit 40 is connected with an auxiliary pump 41 as well as with a pressure-limiting valve 42 and an oil cooler 43 connected to the outlet thereof, as well as with a filter 44. Furthermore, the spaces 37 are connected through passageways 45 and outlet valves 46 with a pressure chamber 47 which is connected through a pressure conduit 48 with a pressure-limiting valve 49. Located downstream of the pressure-limiting valve 49 is a pressure head throttle 50, and between the pressure-limiting valve 49 and the pressure head throttle 50 there branches off the adjusting pressure conduit 27. The discharges downstream of the pressure head throttle 50 and the filter 44, which are concurrently the suction pump sump for the auxiliary pump 41, are presently designated by the same reference numeral 51.

The described piston pump functions as follows:

The drive shaft is set into rotation through a power drive machine (not shown). Correspondingly, there is rotated the oblique disk 20. The drive pistons 18 are pressed towards the right by means of the oblique disk 20 as shown in FIG. 1. Thereby, the pressurized liquid which forms the hydraulic columns 3 is compressed in the spaces 37 and the respective pressure piston 8 is moved towards the right as shown in FIG. 1. The pressure piston 8 is supported by its pusher 36 on the associated pump piston 6 which, through a movement of the pressure piston 8, exerts a stroke movement as shown in FIG. 1 towards the right and through the pressure valve 12 conducts the liquid previously aspirated through the suction valve 10 into liquid outlet 13. In the hydraulic column 3 there is hereby generated a pressure which is proportional to the liquid pump pressure and, in effect, reversely proportional to the ratio of the active piston surface of the pressure piston 8 with the active piston surface of the pump piston 6. Through this proportional pressure in the hydraulic column 3, by means of the pressurized liquid of the hydraulic column, there is lubricated pressure guide 19 through the passageway 52, the drive pistons 18 in the cylinder bores 17, and the pressure piston 8. Hereby, there are created precisely the same lubricating relationships as in a conventional oblique disk pump.

When the piston 18, which as previously described has moved towards the right in FIG. 1, reaches its correct dead center point (the pressure stroke is shut off), then there occurs a reversal in direction, in effect, through movement of the piston 18 towards the left there is initiated the suction stroke at the pump piston 6. The pump spring 7 which acts on the pump piston 6 moves the pump piston 6, and together therewith the pressure piston 8, towards the left as shown in FIG. 1. Aspirated herewith is liquid from the liquid inlet 11 through the suction valve 10. Also in the hydraulic column there is produced a lower pressure through the force of the pump spring 7 which presses the drive piston 18 with its pressure guide 19 against the oblique disk 20. By means of the pressure stroke of the piston 18, as described in the previous paragraph, during the exertion of the described lubricating function there are produced leakage losses of pressurized liquid in the hydraulic column 3, which must be compensated.

This is effected in that, through the auxiliary pump 41, the inlet cnduit 40 and the respective inlet valve 38 the leakage quantity of pressurized liquid is replenished while under a low inlet pressure. The axial force exerted on the pressure piston 8 of the hydraulic column 3 through the inlet must be lower than the axial force which is exerted by the pump spring 7 during the suction stroke. Otherwise, the pump piston 6 would not carry out a suction stroke.

Inasmuch as during the pressure stroke of each pump piston 6, the pressure produced in the hydraulic column 3 is proportional to the liquid pressure of the pump, this pressure can be utilized in the hydraulic column 3 in order to undertake a regulation of the liquid pressure of the pump. Through the adjustable pressure limiting valve 49 which limits the maximum pressure in the hydraulic column 3, and the pressure head throttle 50 located downstream thereof, there is an adjusting pressure taken off which acts through the conduit 27 on the adjusting piston 28. Through this, by means of the described adjusting arrangement, there is regulated the angle of inclination of the oblique disk 20 and thereby the stroke of the drive pistons 18 and the pump piston 16 in conformance with the desired discharge pressure.

In the illustrated embodiment, the pressure pistons 18 are constructed as pressure increasing pistons in which the effective piston surfaces facing the hydraulic column are, for example, twice as large as the effective piston surfaces of the pump pistons 6. When the operating pressure at the liquid outlet 13 of the pump consists, for example, of 800 bar, then the operating pressure in the hydraulic column 3 is 400 bar. The construction of the pressure piston with a cylinderical bore 53 into which the drive piston 18 can extend during the pressure stroke leads to a particularly short space-saving arrangement.

In the region of the hydraulic columns 3 there are produced losses through heating of the pressurized liquid. These can be diminished through the oil cooler 43 which, suitably, is constructed as an oil-water cooler when the pump operates as a water pump whereby the water on the pump side can be utilized for cooling. When a high grade hydraulic oil is utilized as the pressurized medium, this is suitably constantly filtered through the filter 44.

What is claimed is:

1. In a high-pressure piston pump for liquids, particularly for water, including a valve control through a suction and pressure valve; a hydraulic drive for moving the pump piston at least in the pressure direction; the improvement comprising: said hydraulic drive including an axial piston machine of the oblique disk construction type, having an adjustable, rotationally driven oblique disk for stroke adjustment; drive pistons each coupled through a hydraulic column with one of the pump pistons; said hydraulic columns being connected with a pressure-limiting valve through a discharge valve opening only to the pressure-limiting valve, wherein an adjusting pressure is branched off dependent upon the pressure level in the hydraulic column, said pressure acting on the adjusting arrangement of the adjustable oblique disk of said axial piston machine.

2. Piston pump as claimed in claim 1, said pressure piston being a pressure increasing piston having an effective piston surface facing towards the hydraulic column, said surface being larger than the effective piston surface of the associated pump piston.

3. Piston pump as claimed in claim 1, said piston being a pressure reducing piston having an effective piston surface facing towards the hydraulic column, said surface being smaller than the effective piston surface of the associated pump piston.

4. Piston pump as claimed in claim 1, comprising a pressurized medium source being connected to said hydraulic columns through one inlet valve opening to the hydraulic column for the inlet of pressurized liquid lost through leakage.

5. Piston pump as claimed in claim 1, said pressure-limiting valve being an adjustable valve.

6. Piston pump as claimed in claim 1, wherein the drive pistons of the axial piston machine are positioned along the longitudinal axis in alignment opposite the pressure pistons and the pump pistons.

7. Piston pump as claimed in claim 6, wherein the pressure pistons of the hydraulic column are displaceably arranged in a cylinder bore in the cylinder member of the axial piston machine axially adjoining the cylinder bore for the drive piston; and including a pusher for directly contacting the associated pump piston.

8. Piston pump as claimed in claim 7, each said pressure pistons including a cylindrical bore on the side facing towards the respective drive piston, said drive piston partially projecting into said bore at least during the pressure stroke.

9. In a high-pressure piston pump for liquids, particularly for water, including a valve control through a suction and pressure valve; a hydraulic drive for moving the pump piston at least in the pressure direction; the improvement comprising: said hydraulic drive including an axial piston machine of the oblique disk construction type, having an adjustable, rotationally driven oblique disk for stroke adjustment; drive pistons each coupled through a hydraulic column with one of the pump pistons; said oblique disk being supported in said axial piston machine fixed against rotation relative to the axis of rotation thereof and being pivotally arranged transverse to the axis of rotation, the adjusting arrangement of the oblique disk including an adjusting cylinder with adjusting pistons located in a stationary cylinder member being adjustable in the axial direction of the drive shaft of the axial piston machine, and being acted upon by the adjusting pressure, said adjusting piston cooperating with an adjusting rod, said rod being rotatable with the drive shaft and being slidably guided in the axial direction of the drive shaft against the force of a spring, said rod traversing the oblique disk and carrying a sliding block located within an inclined slide extending in the oblique disk.

* * * * *

UNITED STATES PATENT AND TRADEMARK OFFICE

CERTIFICATE OF CORRECTION

PATENT NO. : 4,443,160

DATED : April 17, 1984

INVENTOR(S) : Heinz Berthold

It is certified that error appears in the above-identified patent and that said Letters Patent is hereby corrected as shown below:

Column 5, line 23 "The inlet cnduit" should be --The inlet conduit--.

Signed and Sealed this

Twenty-third Day of November, 1993

*Attest:*

*Attesting Officer*

BRUCE LEHMAN

*Commissioner of Patents and Trademarks*